US005659160A

United States Patent [19]

Tracey

[11] Patent Number: 5,659,160

[45] Date of Patent: Aug. 19, 1997

[54] LINEAR BELT DOOR OPERATOR

[75] Inventor: Michael J. Tracey, Cromwell, Conn.

[73] Assignee: Otis Elevator Company, Farmington, Conn.

[21] Appl. No.: 494,044

[22] Filed: Jun. 23, 1995

[51] Int. Cl.[6] ..... B66B 13/14; E05C 7/06; E05F 17/00

[52] U.S. Cl. ..... 187/316; 187/321; 187/315; 49/116; 49/123

[58] Field of Search ..... 187/316, 327, 187/321, 318, 315, 313; 49/116, 120, 118, 121, 123

[56] References Cited

U.S. PATENT DOCUMENTS

| | | | |
|---|---|---|---|
| 1,508,270 | 9/1924 | Connelly | 49/116 |
| 1,594,513 | 8/1926 | Ainsworth . | |
| 2,937,867 | 5/1960 | Schweig | 268/59 |
| 3,553,890 | 1/1971 | Stretton | 49/32 |
| 3,834,081 | 9/1974 | Catlett | 49/360 |
| 4,177,881 | 12/1979 | Kappenhagen | 187/56 |
| 4,991,347 | 2/1991 | Takimoto et al. | 49/40 |
| 5,271,181 | 12/1993 | Pietro | 49/118 |

FOREIGN PATENT DOCUMENTS

| | | | |
|---|---|---|---|
| 1-261190 | 10/1989 | Japan | 187/316 |
| 1104057 | 3/1968 | United Kingdom . | |

*Primary Examiner*—Robert Nappi

[57] ABSTRACT

Disclosed is a door operator mounted in a space between a cab fascia and a sill edge plane. A feature of the door operator is a drive unit having a drive shaft, the drive unit being mounted in a central portion of the door operator, wherein drive pulleys are fastened to the drive shaft, thereby providing a drive force to linear transmission elements disposed about each of the drive pulleys. Another feature of the door operator is a modular mounting plate, wherein the door operator is mounted to the mounting plate, and in turn, the mounting plate is mounted in the space between the cab fascia and the sill edge plane.

16 Claims, 3 Drawing Sheets

LINEAR BELT DOOR OPERATOR

TECHNICAL FIELD

The present invention relates generally to door operators for elevator cabs, and more particularly, to a linear belt door operator for use in a space between an elevator cab fascia and a sill edge plane.

BACKGROUND OF THE INVENTION

Introduction

In an elevator system, elevator cabs carry passengers vertically from floor-to-floor through a hoistway. At landings within the hoistway, passengers can enter and exit the cab through the operation of an elevator door system. A typical elevator door system comprises one or more elevator cab doors and hoistway doors slidingly mounted in parallel horizontal planes, and moved between an open and closed position by an automatic door operator.

Elevator Cab and Hoistway

Typically, an elevator cab is rectangular-prismed in shape, and contains on opening in at least one of the cab walls for the cab doors. This opening for the cab doors spans a width and height sufficient to load and unload passengers, and usually does not equal the width and height of the cab walls. At the base of the opening is a "cab sill." The cab sill provides a base for the cab doors, and also provides a platform that projects away from the cab and towards the hoistway opening. This projecting platform assists passengers in traversing the gap between the cab and the hoistway, while also serving to protect passengers from falling between this gap.

Adjacent to the sides of the cab door opening are the remaining portions of the cab wall. These remaining portions typically house various mechanical and electronic components used in the operation of the elevator system. In order to house these components within these remaining portions of the cab wall, it is common that these walls comprise an outer and inner wall component; wherein the outer wall component is located closer to the hoistway wall and the inner component is located closer to the cab interior. Typically, the distance between the outer and inner walls that is necessary to house these mechanical and electronic components is approximately 95 mm. At a certain height within the cab, there is no longer a need to house mechanical or electronic components within the side walls, and subsequently, wall thicknesses of the type previously described are no longer needed. However, in the typical elevator cab, it is desirable to maintain each of the inner walls of the cab in substantially planar alignment, without any unsightly angles or ledges. Therefore, those inner walls continue to extend upward, in a planar fashion, toward the cab interior's ceiling. At that same point, the outer wall of the elevator cab for that section jogs horizontally toward the inner wall, forming a ledge in the upper portion of the cab's exterior. This ledge, which usually spans the width of the cab, is known as the "fascia" of the elevator cab.

An important measurement in the design of elevator systems is the distance from any portion of the cab to a geometrical plane perpendicular to the portion of the sill closest to the hoistway. This plane marks the outermost point that any mechanism or structure can project away from the front side of the cab without striking any part of the hoistway during elevator operation. Hereinafter, this geometrical plane perpendicular to the portion of the sill closest to the hoistway will be referred to as the "sill edge plane."

Cab Doors

Two typical door configurations in elevator cabs are the center-opening configuration and the side-opening configuration. In the center-opening configuration, two doors, each having a width approximating half the width of the cab door opening, are slidingly mounted adjacent to each other. An opening is created as the doors slide away from each other, and conversely, a closure is formed as the doors slide toward each other. In the side-opening configuration, a single door, having a width approximating the cab door opening, is slidingly mounted at one side of the elevator cab. The door slides horizontally to form the passenger opening.

Automatic Door Operators

In order to move the center-opening or side-opening door configurations, an automatic door operator is utilized. The automatic door operator provides linear forces to the cab doors, thereby moving the cab doors along a horizontal plane. Typically, automatic door operators comprise an electric motor attached to either linkages or linear belts that move the doors.

In motor-linkage systems, mechanical linkages are used to convert the rotational forces created by the motor into linear forces that can move the cab doors. In motor-linear belt systems, the rotational forces created by the motor are directly converted into linear forces through a system of belts, pulleys, and door hangers.

In a typical motor-linear belt system, a motor is mounted to one side of the canopy of the elevator cab, wherein the axis of rotation of the motor shaft is perpendicular to the sliding plane of the cab doors. The motor shaft is connected to a transmission pulley through a reduction belt, with a transmission belt horizontally looped between the transmission pulley and an idle pulley. Door hangers are then fixed to the transmission belt to provide a means for fixing the cab doors to the transmission belt.

When the motor-linear belt system is used in operation with a center-opening door configuration, one of the doors is fixed to the upper portion of the transmission belt loop, while the other door is fixed to the lower portion of the transmission belt loop. Upon rotation of the motor shaft, the upper and lower portions of the transmission belt translate horizontally in opposite directions, thereby opening or closing the cab doors.

DISCLOSURE OF THE INVENTION

It is accordingly one object of the present invention to provide a linear belt door operator for an elevator system that can be mounted in a space between an elevator cab fascia and a sill edge plane.

Another object of the present invention is to provide a linear belt door operator for an elevator system that uses a center-mounted, dual-belt direct drive system, thereby eliminating the need for the use of gears and long drive belts in the system.

Still another object of the present invention is to provide a linear belt door operator for an elevator system that is modular in design, can be preassembled at a factory, and can easily be removed and replaced on-site by service technicians.

Another object of the present invention is to provide a linear belt door operator for an elevator system that is accessible by service technicians through a hoistway opening.

Yet another object of the present invention is to provide a linear belt door operator for an elevator system that works effectively in conjunction with an elevator cab having a combination of a high canopy height and cab doors of conventional height.

These objects are achieved in the present invention, which comprises a door operator mounted in a space between a cab fascia and a sill edge plane.

A feature of the door operator is a drive unit having a drive shaft, the drive unit being mounted in a central portion of the door operator, wherein drive pulleys are fastened to the drive shaft, thereby providing a drive force to linear transmission elements disposed about each of the drive pulleys.

Another feature of the door operator is a modular mounting plate, wherein the door operator is mounted to the mounting plate, and in turn, the mounting plate is mounted in the space between the cab fascia and the sill edge plane.

A principal advantage of the door operator is the forward facing mounting position of the door operator between the elevator cab fascia and the sill edge plane. This mounting position allows greater access to the important components of the door operator through a hoistway opening, thereby promoting ease of maintenance. The mounting position also allows for the use of door hangers of conventional length to be fixed between the linear transmission elements and each of the center-opening doors. These conventional door hangers may be used irrespective of large differences between the cab door height and cab canopy height.

Still another advantage of the door operator is the location of the drive unit and the attached drive pulleys between the linear transmission elements. This location between the linear transmission elements greatly reduces the bearing loads on the drive unit, and improves the performance of the door operator.

Yet another advantage of the door operator is the mounting of the door operator on a modular mounting plate. This type of mounting means allows the door operator to be preassembled as a unit at a factory, and installed on-site as one piece. The releasable nature of the mounting plate allowing the unit to be removed from the elevator cab after it has been in use for a time, thereby allowing the door operator to be repaired off-site, or to be replaced by a new unit.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of modifications in various respects, all without departing from the invention. Accordingly, the drawings and description are to be regarded as illustrative in nature, and not as restrictive.

BEST MODE FOR CARRYING OUT THE INVENTION

Introduction

Figure 1:
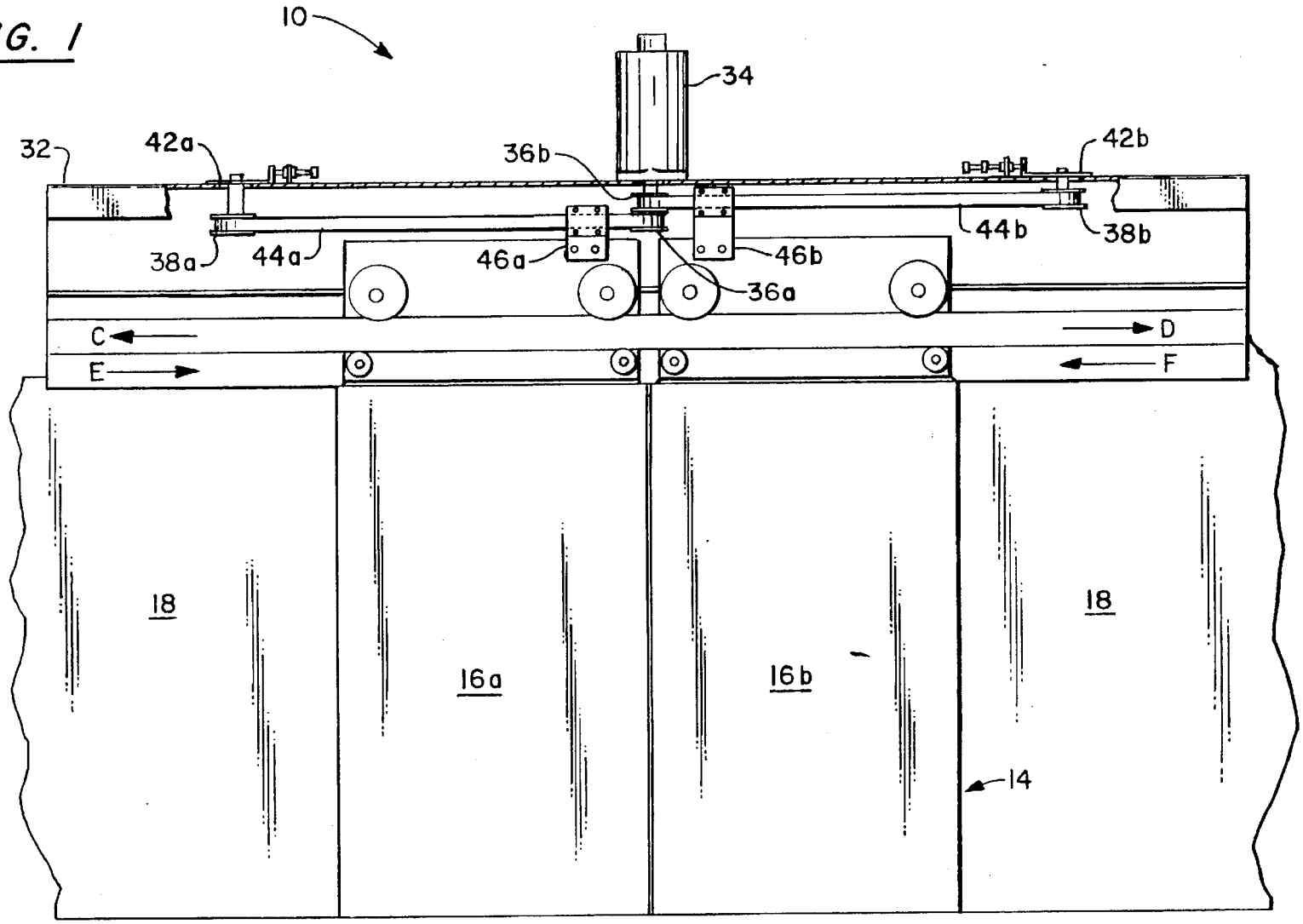
FIG. 1 is a front schematic view of a linear belt door operator of the present invention installed in a space between an elevator cab fascia and a sill edge plane, with the center-opening doors in a closed position.
Figure 1A:
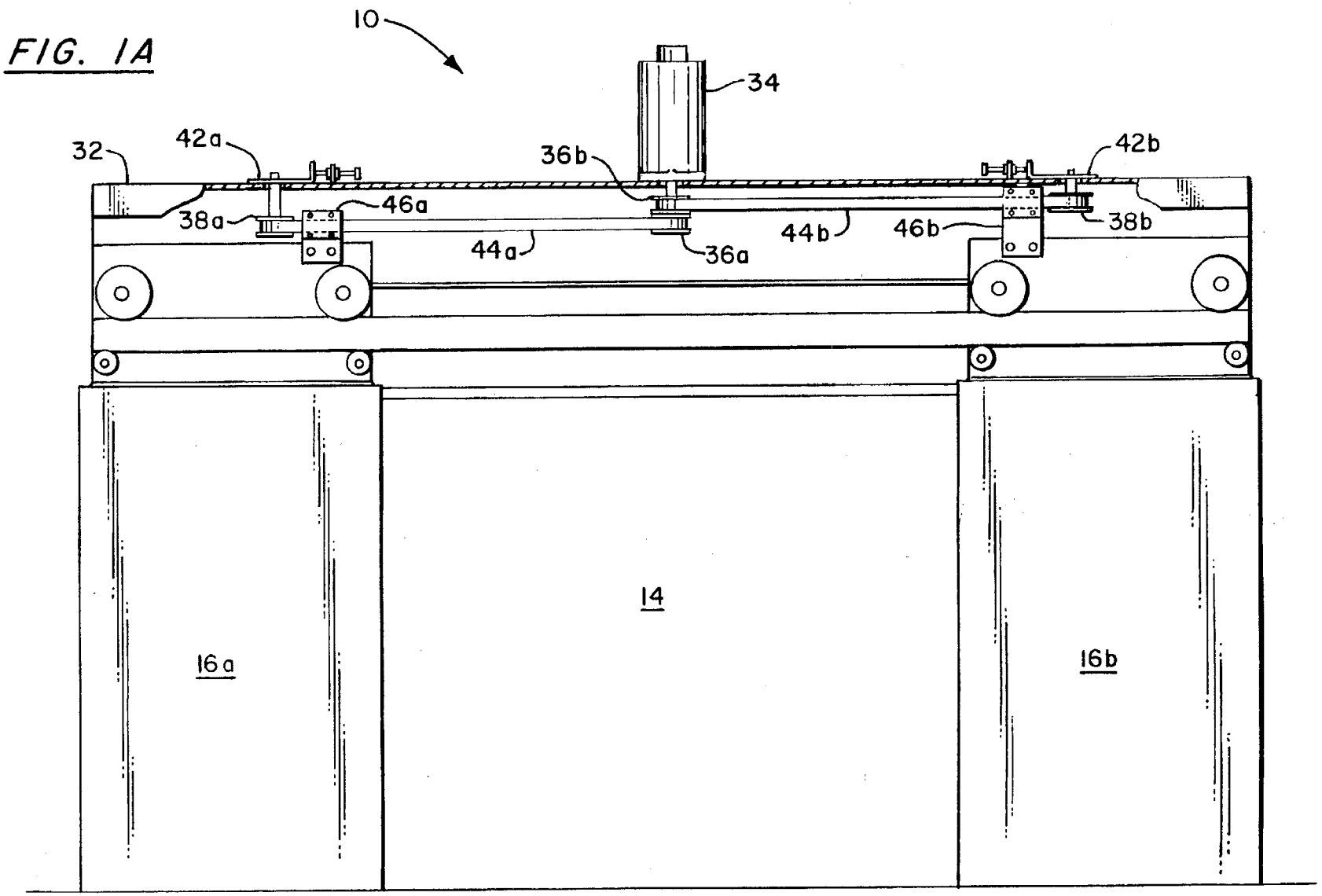
FIG. 1A is a front schematic view of the linear belt door operator of FIG. 1, with the center-opening doors in an open position.

An embodiment of a linear belt door operator 10 for use in an elevator (hereinafter door operator) employing the concepts of the present invention is illustrated in FIG. 1. In a preferred embodiment of the present invention, an elevator cab 12 having a door opening 14 is mounted for travel within a hoistway (not shown). Two center-opening doors 16*a,b* are slidingly mounted in a horizontal plane within the door opening 14 and are capable of sliding between a closed position, as illustrated in FIG. 1, and an open position as illustrated in FIG. 1A. The sliding of the center-opening doors 16 is controlled by a door operator 10.

Elevator Cab and Hoistway

Figure 2:
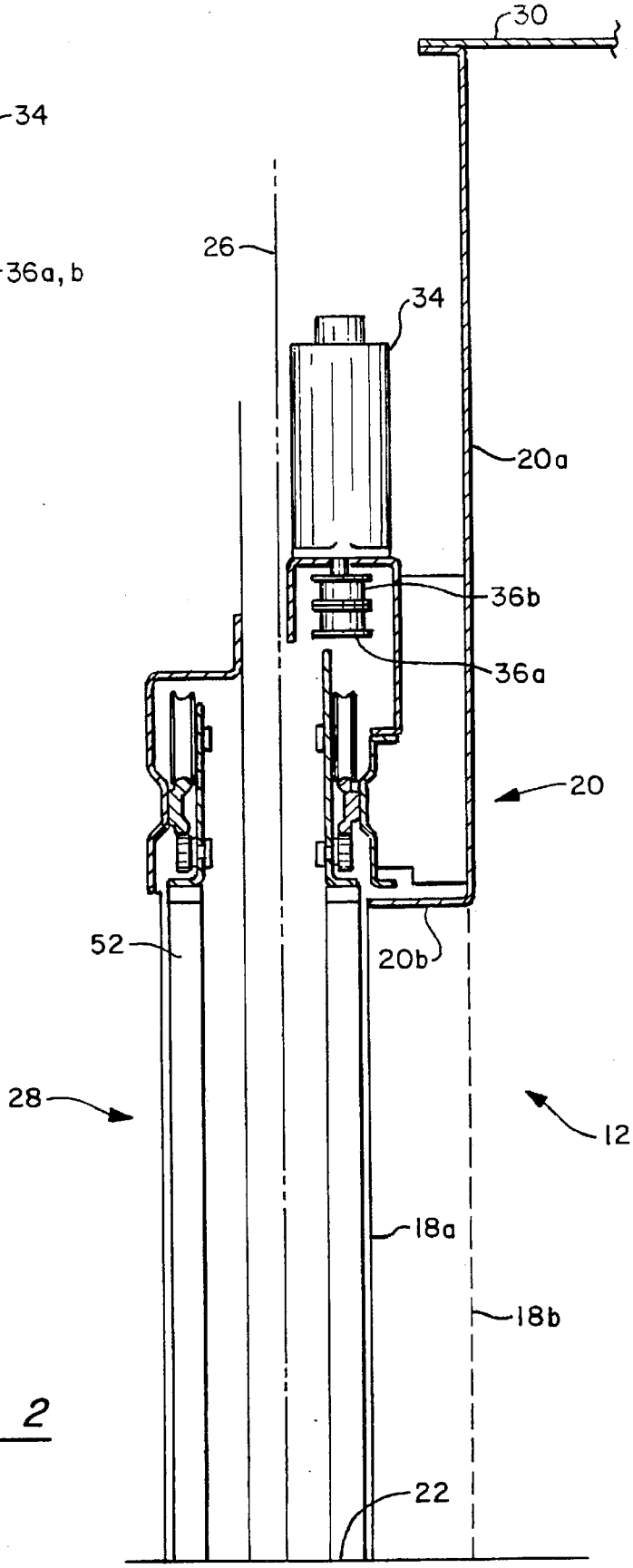
FIG. 2 is a side schematic view of the linear belt door operator of FIG. 1, showing the cab fascia, and the relative locations of the cab and hoistway doors.

As depicted in FIGS. 1 and 2, the front of the cab 12 faces a hoistway opening 28. A door opening 14 is located near the center of the front of the cab 12, wherein the side edges of the door opening 14 are defined by side walls 18, and wherein the top and bottom edges of the door opening 14 are defined by a fascia 20, and a car sill 22, respectively. A sill edge plane 26 extends vertically at a ninety degree angle from the edge of the car sill 22 near the hoistway opening 28. The side walls 18 further comprise outer walls 18*a* and inner walls 18*b* (see FIG. 2), wherein the outer walls 18*a* are proximal to the hoistway, and the inner walls 18*b* are proximal to the interior of the cab 12.

In a preferred embodiment, the outer walls 18*a* and inner walls 18*b* maintain a spacing apart of approximately 95 mm as they extend upward from the floor of the cab 12. This spacing is variable from elevator to elevator, and depends on the spacing needed to house electrical, mechanical, or other components or supplies for use in the operation of the elevator system. As the outer walls 18*a* and inner walls 18*b* reach a height where increased wall thicknesses are no longer necessary, the outer walls 18*a* jog over horizontally toward the inner walls 18*b* to form the ledge-like fascia 20. After the intersection of the outer wall 18*a* with the inner wall 18*b*, a single outer wall 18*a* extends upwards toward the canopy 30 of the cab 12.

In a preferred embodiment, the height of the side wall 18 at which this transition takes place closely approximates the height of the center-opening doors 16*a,b*. Therefore, at this height, a fascia 20 is formed that runs the width of the front of the cab 12, and has a depth equal to the preferred 95 mm thickness between the inner walls 18*b* and outer walls 18*a*.

However, in alternative embodiments, the height at which the fascia 20 is formed may be located higher or lower than the preferred center-opening door 16*a,b* height. The fascia 20 need not run the full length of the front of the cab 12, may be located at single or multiple discrete locations along the cab 12, and may traverse sections of the bottom of the cab 12.

Door Operator

In a preferred embodiment, a motor 34 is mounted to the mounting plate 32 at a location substantially near the center of the door opening 14. The motor 34 is mounted vertically such that the axis of rotation of its drive shaft (not shown) is parallel with the mounting plate 32. As depicted in FIG. 1, two toothed drive pulleys 36*a,b* are fixed to the drive shaft of the motor 34, such that the axis of rotation of each drive pulley 36*a,b* is co-axial with the rotation axis of the drive shaft of the motor 34. Upon rotation of the motor 34, the drive pulleys 36*a,b* rotate at the same rotational speed as the drive shaft of the motor 34.

Returning to FIGS. 1 and 1A, two stationary idlers 38*a,b* are located at the side edges of the mounting plate 32, wherein the axis of rotation of these idlers 38*a,b* are parallel and coplanar with the axis of rotation of the drive pulleys 36*a,b*. The left side idler 38*a* is mounted in a vertical position that horizontally aligns the left side idler 38*a* with the lower drive pulley 36*a*. Conversely, the right side idler 38*b* is mounted in a vertical position that horizontally aligns the right side idler 38*b* with the upper drive pulley 36*b*. Each of the idlers 38*a,b* are mounted onto adjustable mounting plates 42*a,b*, which allow the idlers 38*a,b* to translate horizontally both towards and away from the drive pulleys 36*a,b*, thereby facilitating in the tensioning of toothed belts 44*a,b* disposed about the drive pulleys 36*a,b* and idlers 38*a,b*. The adjustable plates 42*a,b* further comprise two metal plates slidingly fastened together with a threaded bolt and nut arrangement (not shown), wherein rotation of either the threaded bolt, or nut, results in horizontal translation of the portion of the plate not mounted to the mounting plate 32.

In a preferred embodiment, a toothed left side belt 44*a* is disposed in a closed loop about the left side idler 38*a* and the lower drive pulley 36*a*. The tooths of the left side belt 44*a* mesh with the tooths of the lower drive pulley 36*a*, thereby efficiently translating the rotational forces from the lower drive pulley 36*a* to the left side belt 44*a*. A toothed right side belt 44*b* is disposed in a closed loop about the fight side idler 38*b* and the upper drive pulley 36*b*. Similar to the left side belt 44*a*, the tooths of the right side belt 44*b* mesh with the tooths of the upper drive pulley 36*b*, thereby efficiently translating the rotational forces from the upper drive pulley 36*b* to the right side belt 44*b*.

The advantage of the motor 34 and double drive pulley 36*a,b* layout of the preferred embodiment lies in its ability to keep the total depth of the door operator 10 to a minimum, thereby allowing the door operator 10 to fit within a space between the cab fascia 20 and the sill edge plane 26. If the depth of the door operator 10 was such that it extended beyond the horizontal distance provided by the space between the cab fascia 20 and the sill edge plane 26, then in order to prevent the door operator 10 from making contact with the hoistway wall, the cab door opening 14 would have to be moved back and away from the hoistway, thereby creating an excessive gap between the cab doors 16*a,b* and the hoistway opening 28. This excessive gap is not desirable when designing elevator systems.

Figure 3:
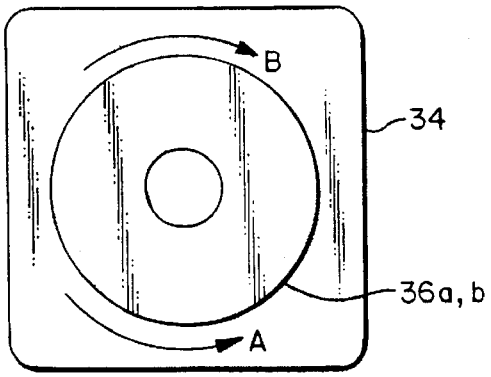
FIG. 3 is a bottom view of the motor and drive pulleys as mounted in the linear belt door operator of FIG. 1.

A left side door hanger 46*a* is fixed to the portion of the left side belt 44*a* that is proximal to the hoistway opening 28 and distal from the mounting plate 32. A right side door hanger 46*b* is fixed to the portion of the right side belt 44*b* that is proximal to the mounting plate 32, and distal from the hoistway opening 28. The lower portion of the door hangers 46*a,b* are fitted with means to attach each of the door hangers 46*a,b* to the top of each of the center-opening doors 16*a,b*. Referring to FIGS. 1, 1A, and 3, the fixing position of the door hangers 46*a,b* to the belts 44*a,b*, and the attaching positions of the door hangers 46*a,b* to the center-opening doors 16*a,b* are calibrated so that upon rotation of the drive pulleys 36*a,b* in a first direction A, the center-opening doors 16*a,b* will open, and upon rotation of the drive pulleys 36*a,b* in a second direction B, the center-opening doors 16*a,b* will close.

The use of the drive pulleys 36*a,b* and opposed belts 44*a,b* attached directly to the shaft of the motor 34, helps alleviate a drawback in the prior art linear belt operators, namely, the bearing load on the motor 34. In the prior art, a reduction belt is disposed between the drive motor shaft and the transmission pulley, thereby pulling the drive motor shaft in a direction towards the transmission pulley. This constant pulling force caused by the belt in one direction, may eventually lead to damage to the drive motor due to the uneven bearing load the drive motor will encounter.

In contrast, the present invention door operator 10 uses a direct-drive dual-loop belt system that disposes both of the drive belts 44*a,b* about the shaft of the motor 34, thereby lessening the bearing load on the shaft of the motor 34. Although the non-alignment of the two belts 44*a,b* on the shaft of the motor 34 does not perfectly cancel out the forces applied by each of the belts 44*a,b* on the shaft of the motor 34, it is a significant improvement over the prior art design.

In addition, the use of two, short drive belts 44*a,b*, instead of one long drive belt, distinguishes the present invention over the prior art. It is known that belts of shorter lengths provide greater strength and durability than belts of longer lengths. Whereas the prior art linear belt door operator necessitated the use of a belt loop that spans the entire width of the cab door opening 14, the present invention door operator 10 makes use of two, shorter length belts 44*a,b*, each spanning a distance from the center of the cab door opening 14 to the edges of the cab door opening 14. This shorter belt arrangement results in enhanced performance characteristics of the door operator 10 when compared to the prior art.

Another drawback of the prior art linear belt door operator involves the length of the door hangers. In many elevator designs, the distance between the top of the cab doors to the canopy of the cab is quite large, and necessitates the use of long door hangers to attach the cab doors to the door operator's transmission belt. Upon actuation of the cab doors with these long hangers, the torquing force created due to the distance between the belt and the door, may twist the door hangers and substantially impair the door operator's performance. As an alternative to using these long door hangers, the prior art discloses a door operator using increased door height. This approach is very limited, since the added material needed for the extra door height increases cab weight, which is undesirable when designing elevator systems.

In addition, the extra height between the top and base portion of the doors, and the additional weight of the extra height doors, leads to a large torquing force on the doors which interferes with the desirable linear forces on the doors and affects the proper performance of the door system. In the present invention, the door operator 10 uses door hangers and door heights of conventional length and size, thereby reducing these undesirable torquing effects.

Mounting of the Door Operator

As depicted in FIGS. 1, 1A, and 2, the door operator 10 is mounted in a space between the cab fascia 20 and the sill edge plane 26, and provides linear forces to slide the center opening doors horizontally 16*a,b* between an open position and closed position within the door opening 14. This space between the fascia 20 and the sill edge plane 26, is further defined as a rectangular-prism with a width defined by the width of the cab, depth defined by the distance from the sill edge plane to the vertical portion of the cab fascia 20*a*, and height defined by the distance from the horizontal portion of the fascia 20*b* to a vertical most point in the hoistway (not shown).

In a preferred embodiment, the motor 34, drive pulleys 36*a,b*, and the idlers 38*a,b*, are conventionally secured to a mounting plate 32, which in turn is mounted to brackets (not shown) between the fascia 20 and the sill edge plane 26. It is preferred that the mounting plate 32 is mounted to the brackets with removable fasteners such as a bolt and nut arrangement, thereby providing for future removal, reinstallation, or replacement of the door operator 10. It is also preferred that the removable fasteners are located so that a mechanic will have easy access to them in the event the door operator is in need of service.

As noted previously, prior art linear belt door operators are mounted on the canopy of the elevator cab. This mounting point is necessitated by the dimensions of the prior art linear belt door operator. A typical prior art linear belt door operator has a depth from the front of the elevator cab of approximately 320 mm. This depth takes into account the depth of the motor, plus the depth of the transmission pulley arrangement. When looking at a typical elevator cab, the only place on the cab that can accommodate a door operator of this depth is atop the canopy. In contrast, the present invention door operator 10, has a depth of approximately 146 mm, which easily fits into a typical 181 mm distance between the vertical portion of the fascia 20*a* and the sill edge plane 26.

Door Operator Operation

When the preferred embodiment of the present invention is in operation, the motor 34 produces a torque, which rotates the drive pulleys 36*a,b* in the same direction as the torque produced by the motor 34. The rotation of the drive pulleys 36*a,b* set the belts 44*a,b* in motion, causing each of the belts 44*a,b* to rotate in a closed loop between the drive pulleys 36*a,b* and the idlers 38*a,b* in the same rotational direction as the torque produced by the motor 34.

To open the center-opening doors 16*a,b*, the left side door hanger 46*a* is fixed to the portion of the left side belt 44*a* proximal to the hoistway opening 28 and distal from the mounting plate 32, such that upon rotation of the shaft of the drive motor 34 in the first direction A, the left side door hanger 46*a* travels horizontally in a leftward direction C. The right side door hanger 46*b* is fixed to the portion of the right side belt 44*b* proximal to the mounting plate 32 and distal from the hoistway opening 28, such that upon rotation of the shaft of the drive motor 34 in the first direction A, the right side door hanger 46*b* travels horizontally in a rightward direction D. FIG. 1A depicts the center-opening doors 16*a,b* in an open position.

To close the center-opening doors 16*a,b*, the left side door hanger 46*a* is fixed to the portion of the left side belt 44*a* proximal to the hoistway opening 28 and distal from the mounting plate 32, such that upon rotation of the shaft of the drive motor 34 in the second direction B, the left side door hanger 46*a* travels horizontally in a rightward direction E. The right side door hanger 46*b* is fixed to the portion of the right side belt 44*b* proximal to the mounting plate 32 and distal from the hoistway opening 28, such that upon rotation of the shaft of the drive motor 34 in the second direction B, the right side door hanger 46*b* travels horizontally in a leftward direction F.

Maintenance of the Door Operator

To install the door operator 10, the mounting plate 32 is positioned so that it can be mounted to brackets in the space between the fascia 20 and the sill edge plane 26. The brackets may, in turn, be fastened to the vertical portion of the fascia 20*a*, the horizontal portion of the fascia 20*b*, or fastened to any other structure, assembly, or projection on the elevator cab 12, that will allow the door operator 10 to ultimately be positioned in the desired space. This mounting can be through a bolt and nut arrangement, or any combination of bolts, latches or other fasteners that will fasten the mounting plate 32 to the fascia 20. After the mounting plate 32 is fastened, the door hangers 46*a,b* must be fastened to the belt 44 and the center-opening doors 16*a,b*. To help with this installation process, the doors hangers 46*a,b* may be initially attached to either the belt 44 or the center-opening doors 16*a,b*, thereby necessitating only one additional connection for each of the door hangers 46*a,b*.

A drawback of the prior art linear belt door operators lies in the positioning of the electric motor and the transmission pulley to one side of the elevator canopy. This positioning is necessary since the design of the prior art operator requires that the transmission belt is looped between the transmission pulley and an idle pulley located at the other side of the canopy. When servicing the elevator, the motor and transmission pulley are situated so that they cannot be fully exposed when the hoistway doors are open and the cab is dropped so that its canopy is accessible. The location of the motor and transmission pulley place them off to the side of the hoistway opening and makes it very difficult for a mechanic to gain access to them. In order to properly service either of these components, the technician would have to stand on the canopy, making servicing of the cab more dangerous and time consuming.

To provide service to the door operator 10 of the present invention, once the unit is in operation on an elevator cab 12, a mechanic can access the door operator 10 by opening the hoistway doors 52, and positioning the elevator cab 12 so that the door operator 10 is at a convenient height within the hoistway opening 28. The location of the door operator 10 within the space between the fascia 20 and the sill edge plane 26, provides very convenient access of the door operator 10 to the mechanic. The forward-facing positioning of the motor 34, and the drive pulleys 36*a,b*, within the distance spanned by the hoistway opening 28, provides the mechanic with an unobstructed view of the assembly, and provides for ease of repair to these important elements in the door operator 10.

In addition, the modular nature of the door operator 10, would allow mechanics to remove the door operator 10 after the assembly was already in use. To remove the door operator 10, mechanics could disconnect the door hangers 46*a,b*, remove the fasteners connecting the mounting plate 32 to the mounting brackets, and then remove the operator by standing atop the cab's canopy 30 and lifting the door operator 10 upwards. The door operator 10 could then be repaired, or replaced with a new unit.

It will be readily seen by one of ordinary skill in the art that the present invention fulfills all the objects set forth above. After reading the foregoing specification, one of ordinary skill will be able to effect various changes, substitutions of equivalents and various other aspects of the invention as broadly disclosed herein. It is intended that the protection granted hereon be limited only by the definition contained in the appended claims and equivalents thereof.

Although the preferred embodiment of the present invention includes a pair of center-opening doors 16*a,b*, alternative embodiments of the present invention could utilize more than two doors, which are either center-opening, open in one direction, or open in multiple directions. In addition, alternative embodiments could use one door, wherein the single doors would open to one side when fastened to the door operator 10 of the present invention. In all of these embodiments, the door operator 10 would still be mounted in the space between the fascia 20 of the elevator cab 12 and the sill edge plane 26, and would be accessible through the hoistway opening 28.

In other embodiments, the number and location of idlers 38*a,b* used in the door operator 10 may be different than in the preferred embodiment. It is possible to achieve the same horizontal disposition of the belts 44*a,b* using different geometrical orientations of the idlers 38*a,b* and drive pulleys 36*a,b*. It is preferred that the number of moving parts in the door operator 10 is minimized, and that both the length of the belts 44*a,b* and the complexity of the belt loopings are kept at a minimum.

Although it is preferred for the drive pulleys 36*a,b* to be fastened directly to the shaft of the motor 34, in alternative embodiments, the drive pulleys 36*a,b* may be mounted on a conventional shaft, and rotated through the use of any type of in-line, or conventional gearing arrangement. However, the gearing arrangement chosen must still allow the door operator 10 to fit in the space between the cab fascia 20 and the sill edge plane 26.

In alternative embodiments, the belts 44*a,b* may be manufactured from any flexible material and may be toothed in certain sections of the belts 44*a,b,* may be toothed on both sides, may be a combination of partially toothed on both sides, or may be non-toothed. The advantage of using a toothed, or partially-toothed belt lies in the grip the toothed belts can achieve when used in conjunction with a toothed drive pulley. The number of belts 44*a,b* utilized are not limited to two, and the belts 44*a,b* may be formed of belt sections placed together in series, or may take the form of a plurality of belts placed in parallel about the drive pulleys 36*a,b* and idlers 38*a,b*. In addition, alternative transmission elements may be used instead of belts 44*a,b*. These alternative transmission elements may include, but are not limited to, chains, links, ropes, bands, or any other form of element or material capable of operating in a pulley-like arrangement, such as disclosed in the present invention.

The idlers 38*a,b* are mounted to adjustable plates 42*a,b*. These adjustable plates 42*a,b* are capable of sliding horizontally in order to provide tension to the belts 44*a,b,* or to loosen the belts 44*a,b*. In alternative embodiments of the present invention, there can be other devices, assemblies, apparati, or systems for maintaining tension in the belts 44*a,b,* or relieving tension in the belts 44*a,b*. These alternative may include, but are not limited to, spring tensioners, sliding mounts, pivoting mounts, or means on the belts 44*a,b* to facilitate tensioning.

In alternative embodiments, the door operator 10 may be mounted to any portion of the space between the fascia 20 and the sill edge plane 26, or to the fascia 20 itself, with any type of removable or non-removable securing, fastening, gripping, or clamping arrangement. In addition, the motor 34, drive pulleys 36*a,b*, and the idlers 38*a,b* may be individually mounted in the space between the cab fascia 20 and the sill edge plane 26, without the use of the mounting plate 32. These components may be individually mounted removably, non-removably, or a combination of both.

Various changes to the above description may be made without departing from the spirit and scope of the present invention as would be obvious to one of ordinary skill in the art of the present invention.

What is claimed is:

1. A door operator for use in an elevator system having an elevator cab, elevator cab fascia, sill edge plane, and a first and second center-opening door, each of said door translating between an open and closed position, said door operator comprising:

(a) a drive unit having an output shaft disposed along a vertical axis, said output shaft rotating in a first direction and a second direction;

(b) a first drive pulley attached to said shaft;

(c) a first idler pulley;

(d) a first linear transmission element looped about said first drive pulley and said first idler pulley, said first linear transmission element being driven by said first drive pulley, said first door being attached to said first linear transmission element so that as said output shaft rotates in said first direction, said first door translates to said open position, and as said output shaft rotates in said second direction, said first door translates to said closed position;

(e) a second drive pulley attached to said shaft;

(f) a second idler pulley;

(g) a second linear transmission element looped about said second drive pulley and said second idler pulley, said second linear transmission element being driven by said second drive pulley, said second door being attached to said second linear transmission element so that as said output shaft rotates in said first direction, said second door translates to said open position, and as said output shaft rotates in said second direction, said second door translates to said closed position; and (h) means for mounting said door operator within a space between said fascia and said sill edge plane.

2. A door operator as claimed in claim 1, wherein:

said means for mounting said door operator comprises modular mounting means for releasably mounting said door operator in a space between said elevator cab fascia and said sill edge plane.

3. A door operator for use in an elevator system having an elevator cab, elevator cab fascia, sill edge plane, hoistway opening, and a first and second center-opening door, each of said door translating between an open and closed position, said hoistway opening having opposed vertical edges, said door operator comprising:

(a) a drive unit having an output shaft disposed along a vertical axis, said output shaft rotating in a first direction and a second direction;

(b) a first drive pulley attached to said shaft;

(c) a first idler pulley;

(d) a first linear transmission element looped about said first drive pulley and said first idler pulley, said first linear transmission element being driven by said first drive pulley, said first door being attached to said first linear transmission element so that as said output shaft rotates in said first direction, said first door translates to said open position, and as said output shaft rotates in said second direction, said first door translates to said closed position;

(e) a second drive pulley attached to said shaft;

(f) a second idler pulley;

(g) a second linear transmission element looped about said second drive pulley and said second idler pulley, said second linear transmission element being driven by said second drive pulley, said second door being attached to said second linear transmission element so that as said output shaft rotates in said first direction, said second door translates to said open position, and as said output shaft rotates in said second direction, said second door translates to said closed position; and (h) means for mounting said drive unit in a space between said cab fascia and said sill edge plane, said drive unit being mounted at a mounting point located between a distance spanned by said opposed vertical edges of said hoistway door opening, wherein said drive unit location promotes ease of access through said hoistway door opening for repair of said drive unit.

4. A door operator as claimed in claim 3, wherein:

said means for mounting said door operator comprises modular mounting means for releasably mounting said door operator in a space between said elevator cab fascia and said sill edge plane.

5. A door operator for use in an elevator system having an elevator cab, elevator cab fascia, sill edge plane, and a door, said door translating between an open and closed position, said door operator comprising:

(a) a drive unit having an output shaft disposed along a vertical axis, said output shaft rotating in a first direction and a second direction;

(b) a drive pulley attached to said shaft;

(c) a idler pulley;

(d) a linear transmission element looped about said drive pulley and said idler pulley, said linear transmission element being driven by said drive pulley, said door being attached to said linear transmission element so that as said output shaft rotates in said first direction, said door translates to said open position, and as said output sham rotates in said second direction, said door translates to said closed position; and (e) means for mounting said door operator within a space between said fascia and said sill edge plane.

6. A door operator as claimed in claim 5, wherein:

said means for mounting said door operator comprises modular mounting means for releasably mounting said door operator in a space between said elevator cab fascia and said sill edge plane.

7. A door operator for use in an elevator system having an elevator cab, elevator cab fascia, sill edge plane, hoistway opening, and a door, said door translating between an open and closed position, said hoistway opening having opposed vertical edges, said door operator comprising:

(a) a drive unit having an output shaft disposed along a vertical axis, said output shaft rotating in a first direction and a second direction;

(b) a drive pulley attached to said shaft;

(c) a idler pulley;

(d) a linear transmission element looped about said drive pulley and said first idler pulley, said linear transmission element being driven by said drive pulley, said door being attached to said linear transmission element so that as said output shaft rotates in said first direction, said door translates to said open position, and as said output shaft rotates in said second direction, said door translates to said closed position; and (e) means for mounting said drive unit in a space between said cab fascia and said sill edge plane, said drive unit being mounted at a mounting point located between a distance spanned by said opposed vertical edges of said hoistway door opening, wherein said drive unit location promotes ease of access through said hoistway door opening for repair of said drive unit.

8. A door operator as claimed in claim 7, wherein:

said means for mounting said door operator comprises modular mounting means for releasably mounting said door operator in a space between said elevator cab fascia and said sill edge plane.

9. A door operator for use with an elevator cab having a narrow fascia, a sill edge plane, and a first and second center opening door, each of said door translating between an open and closed position, said door operator comprising:

(a) a motor having an output shaft disposed along a vertical axis, said output shaft rotating in a first direction and a second direction;

(b) a first linear transmission element driven directly by said output shaft and attaching to said first door so that as said output shaft rotates in said first direction, said first door translates to said open position, and as said output shaft rotates in said second direction, said first door translates to said closed position;

(c) a second linear transmission element driven directly by said output shaft and attaching to said second door so that as said output shaft rotates in said first direction, said second door translates to said open position, and as said output shaft rotates in said second direction, said second door translates to said closed position; and (d) means for mounting said door operator within a space between said fascia and said sill edge plane.

10. A door operator as claimed in claim 9, wherein:

said means for mounting said door operator comprises modular mounting means for releasably mounting said door operator in a space between said elevator cab fascia and said sill edge plane.

11. In an elevator system having an elevator cab, elevator cab fascia, sill edge plane, hoistway opening, and a first and second center-opening door, each of said door translating between an open and closed position, said hoistway opening having opposed vertical edges, said door operator comprising:

(a) a drive unit having an output shaft disposed along a vertical axis, said output shaft rotating in a first direction and a second direction;

(b) a first linear transmission element driven directly by said output shaft and attaching to said first door so that as said output shaft rotates in said first direction, said first door translates to said open position, and as said output shaft rotates in said second direction, said first door translates to said closed position;

(c) a second linear transmission element driven directly by said output shaft and attaching to said second door so that as said output shaft rotates in said first direction, said second door translates to said open position, and as said output shaft rotates in said second direction, said second door translates to said closed position; and (d) means for mounting said drive unit in a space between said cab fascia and said sill edge plane, said drive unit being mounted at a mounting point located between a distance spanned by said opposed vertical edges of said hoistway door opening, wherein said drive unit location promotes ease of access through said hoistway door opening for repair of said drive unit.

12. A door operator as claimed in claim 11, wherein:

said means for mounting said door operator comprises modular mounting means for releasably mounting said door operator in a space between said elevator cab fascia and said sill edge plane.

13. In an elevator system having an elevator cab, elevator cab fascia, sill edge plane, and a door, said door translating between an open and closed position, said door operator comprising:

(a) a drive unit having an output shaft disposed along a vertical axis, said output shaft rotating in a first direction and a second direction;

(b) a linear transmission element driven directly by said output shaft and attaching to said door so that as said output shaft rotates in said first direction, said door translates to said open position, and as said output shaft rotates in said second direction, said door translates to said closed position; and (c) means for mounting said door operator within a space between said fascia and said sill edge plane.

14. A door operator as claimed in claim 13, wherein:

said means for mounting said door operator comprises modular mounting means for releasably mounting said door operator in a space between said elevator cab fascia and said sill edge plane.

15. In an elevator system having an elevator cab, elevator cab fascia, sill edge plane, hoistway opening, and a door, said door translating between an open and closed position, said hoistway opening having opposed vertical edges, said door operator comprising:

(a) a drive unit having an output shaft disposed along a vertical axis, said output shaft rotating in a first direction and a second direction;

(b) a linear transmission element driven directly by said output shaft and attaching to said door so that as said output shaft rotates in said first direction, said door translates to said open position, and as said output shaft rotates in said second direction, said door translates to said closed position; and (c) means for mounting said drive unit in a space between said cab fascia and said sill edge plane, said drive unit being mounted at a mounting point located between a distance spanned by said opposed vertical edges of said hoistway door opening, wherein said drive unit location promotes ease of access through said hoistway door opening for repair of said drive unit.

16. A door operator as claimed in claim 15, wherein:

said means for mounting said door operator comprises modular mounting means for releasably mounting said door operator in a space between said elevator cab fascia and said sill edge plane.

* * * * *